US009626893B2

(12) United States Patent
Kim

(10) Patent No.: US 9,626,893 B2
(45) Date of Patent: Apr. 18, 2017

(54) ORGANIC LIGHT EMITTING DISPLAY DEVICE AND METHOD OF DRIVING THE SAME

(71) Applicant: SAMSUNG DISPLAY CO., LTD., Yongin, Gyeonggi-Do (KR)

(72) Inventor: Cheol-Min Kim, Seongnam-si (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 100 days.

(21) Appl. No.: 14/324,738

(22) Filed: Jul. 7, 2014

(65) Prior Publication Data

US 2015/0015557 A1 Jan. 15, 2015

(30) Foreign Application Priority Data

Jul. 10, 2013 (KR) ..... 10-2013-0080943

(51) Int. Cl.
*G09G 3/32* (2016.01)
*G09G 3/20* (2006.01)
*G09G 3/3233* (2016.01)

(52) U.S. Cl.
CPC ..... *G09G 3/2022* (2013.01); *G09G 3/2077* (2013.01); *G09G 3/3233* (2013.01); *G09G 2300/0819* (2013.01); *G09G 2300/0842* (2013.01); *G09G 2300/0861* (2013.01); *G09G 2310/0245* (2013.01); *G09G 2310/061* (2013.01); *G09G 2320/0238* (2013.01); *G09G 2320/043* (2013.01); *G09G 2320/045* (2013.01)

(58) Field of Classification Search
CPC ..... G09G 3/30; G09G 3/32; G09G 3/3208; G09G 3/3225; G09G 3/3233; G09G 3/325; G09G 3/3258; G09G 3/3283; G09G 3/3291; G09G 2300/08; G09G 2300/0814; G09G 2300/0819; G09G 2300/0842; G09G 2310/0251; G09G 2310/0272; G09G 2310/061; G09G 2320/0257; G09G 2320/0252; G09G 2320/0233

See application file for complete search history.

(56) References Cited

U.S. PATENT DOCUMENTS

2006/0176250 A1* 8/2006 Nathan ..... G09G 3/3233 345/76
2007/0296651 A1 12/2007 Kim et al.
2007/0296672 A1* 12/2007 Kim ..... G09G 3/3233 345/92

(Continued)

FOREIGN PATENT DOCUMENTS

KR 10-2008-0000294 A 1/2008
KR 10-2008-0040339 A 5/2008
KR 10-2009-0093073 A 9/2009

*Primary Examiner* — Priyank Shah
(74) *Attorney, Agent, or Firm* — Lee & Morse P.C.

(57) ABSTRACT

An organic light emitting display device includes a driver to drive at least one pixel. The driver drives the pixel based on a frame which includes at least one data sub-frame and at least one hysteresis reset sub-frame. The driver applies an emission data voltage or a non-emission data voltage to the pixel during the data sub-frame, and applies a reset voltage to reset a driving transistor of the pixel during the hysteresis reset sub-frame. The reset voltage may initialize a voltage-current characteristic of the driving transistor during the hysteresis sub-frame.

12 Claims, 9 Drawing Sheets

(56) References Cited

U.S. PATENT DOCUMENTS

2008/0030436 A1* 2/2008 Iida ..... G09G 3/3233 345/77
2008/0106495 A1 5/2008 Shon et al.
2008/0225061 A1* 9/2008 Kimura ..... H01L 27/1255 345/690
2008/0284691 A1* 11/2008 Chung ..... G09G 3/3291 345/76
2009/0262258 A1* 10/2009 Taneda ..... G09G 3/3233 348/739
2009/0322730 A1* 12/2009 Yamamoto ..... G09G 3/3233 345/213
2010/0171738 A1* 7/2010 Yamashita ..... G09G 3/3233 345/213
2010/0238149 A1* 9/2010 Kishi ..... G09G 3/3233 345/206
2010/0328365 A1* 12/2010 Ikeda ..... G09G 3/3233 345/690
2011/0025671 A1* 2/2011 Lee ..... G09G 3/003 345/211
2011/0122119 A1* 5/2011 Bae ..... G09G 3/3233 345/211
2011/0221791 A1* 9/2011 Kajiyama ..... G09G 3/3233 345/690
2011/0273397 A1* 11/2011 Hanari ..... G06F 3/0412 345/174
2011/0310137 A1* 12/2011 Kajiyama ..... G09G 3/3225 345/690
2012/0019499 A1* 1/2012 Hwang ..... G09G 3/325 345/211
2012/0056866 A1* 3/2012 Lee ..... G09G 3/325 345/212
2012/0146979 A1* 6/2012 Kim ..... G09G 3/3233 345/211
2012/0169799 A1* 7/2012 Ono ..... G09G 3/3233 345/690
2012/0306840 A1* 12/2012 Han ..... G09G 3/003 345/212
2012/0306841 A1* 12/2012 Toya ..... G09G 3/3225 345/212
2012/0313923 A1* 12/2012 Minami ..... G09G 3/3233 345/212
2013/0009933 A1* 1/2013 Toyomura ..... G09G 3/3225 345/211
2013/0120338 A1* 5/2013 Kubota ..... G06F 3/038 345/211
2013/0169702 A1* 7/2013 Ono ..... G09G 5/10 345/690
2014/0071027 A1* 3/2014 Jin ..... G09G 3/3291 345/76
2014/0084805 A1* 3/2014 Kim ..... G09G 3/2048 315/228
2014/0111563 A1* 4/2014 Hwang ..... H04N 13/0438 345/691
2014/0292827 A1* 10/2014 Kang ..... G09G 3/20 345/690
2014/0333214 A1* 11/2014 Okuno ..... G09G 3/32 315/172
2014/0340377 A1* 11/2014 Kishi ..... G09G 3/3225 345/211
2014/0347401 A1* 11/2014 Hwang ..... G09G 3/3233 345/690
2015/0002557 A1* 1/2015 Ishii ..... G09G 3/3291 345/690
2015/0009105 A1* 1/2015 Nomura ..... G09G 3/006 345/76
2015/0049130 A1* 2/2015 Kanda ..... G09G 3/3233 345/690

* cited by examiner (SCAN PERIOD)

(HOLDING PERIOD)

ORGANIC LIGHT EMITTING DISPLAY DEVICE AND METHOD OF DRIVING THE SAME

CROSS-REFERENCE TO RELATED APPLICATION

Korean Patent Application No. 10-2013-0080943, filed on Jul. 10, 2013, and entitled, "Organic Light Emitting Display Device and Method of Driving the Same," is incorporated by reference herein in its entirety.

BACKGROUND

1. Field

One or more embodiments described herein to a display device.

2. Description of the Related Art

An active matrix type of organic light emitting display device may be driven by an analog driving method or a digital driving method. Analog driving methods produce grayscale values of data with variable voltage levels. Also, making an integrated circuit (IC) driver implementing an analog driving method has proven to be difficult for larger and higher resolution panels.

The digital driving method produces grayscale values by causing an organic light emitting diode to emit light with a variable time duration. In comparison to analog driving methods, a simpler IC structure may be used to implement the digital driving method. Therefore, the digital method may be more suitable for high resolution panels. Also, digital driving methods operate based on on- and off-states of a driving thin film transistor (TFT) that may be less influenced by image quality deterioration as a result of TFT characteristic deviation. Therefore, digital driving methods may be more suitable larger size panels.

SUMMARY

In accordance with one or more embodiments, a organic light emitting display device includes a pixel unit including at least one pixel; and a driving unit configured to drive the pixel unit. A frame for driving the pixel in the pixel unit may be divided into a plurality of data sub-frames and at least one hysteresis reset sub-frame, and the driving unit may receive input data for the pixel, selectively apply an emission data voltage or a non-emission data voltage to the pixel according to a value of a corresponding bit of the input data during each data sub-frame, and apply a hysteresis reset voltage to the pixel during the hysteresis reset sub-frame.

The pixel may emit light in response to the emission data voltage and may not emit light in response to the non-emission data voltage, and a voltage-current characteristic of a driving transistor in the pixel may be initialized in response to the hysteresis reset voltage.

A driving transistor in the pixel may operate in a saturation region in response to at least one of the emission data voltage or the non-emission data voltage. The hysteresis reset voltage may have substantially a same voltage level as the emission data voltage. The hysteresis reset voltage may have substantially a same voltage level as the non-emission data voltage.

The hysteresis reset voltage may have a voltage level lower than a voltage level of the emission data voltage and lower than a voltage level of the non-emission data voltage. The hysteresis reset voltage may have a voltage level higher than a voltage level of the emission data voltage and higher than a voltage level of the non-emission data voltage. The hysteresis reset sub-frame may be the only hysteresis reset sub-frame included in the frame. The frame may have two or more hysteresis reset sub-frames.

The pixel may include a storage capacitor having a first electrode coupled to a first power supply voltage and a second electrode coupled to a first node; a switching transistor configured to couple a data line to the first node in response to a scan signal; a driving transistor having a gate terminal coupled to the first node, a source terminal coupled to the first power supply voltage, and a drain terminal coupled to a second node; an emission control transistor having a gate terminal coupled to an emission control line, a source terminal coupled to the second node, and a drain terminal coupled to a third node; and an organic light emitting diode having an anode terminal coupled to the third node, and a cathode terminal coupled to a second power supply voltage.

During the hysteresis reset sub-frame, the emission control transistor may be turned off and the organic light emitting diode may not emit light. The switching transistor, the driving transistor, and the emission control transistor may be implemented as PMOS transistors. The switching transistor, driving transistor, and emission control transistor may be implemented as NMOS transistors.

The pixel may include a storage capacitor having a first electrode coupled to a first power supply voltage and a second electrode coupled to a first node; a switching transistor configured to couple a data line to the first node in response to a scan signal; a driving transistor having a gate terminal coupled to the first node, a source terminal coupled to the first power supply voltage, and a drain terminal coupled to a second node; and an organic light emitting diode having an anode terminal coupled to the second node, and a cathode terminal coupled to a second power supply voltage.

During the hysteresis reset sub-frame, the second power supply voltage may have a voltage level equal to or higher than a voltage level of the first power supply voltage and the organic light emitting diode may not emit light.

In accordance with another embodiment, a method of driving organic light emitting display device includes receiving input data for at least one pixel; selectively applying an emission data voltage or a non-emission data voltage to the pixel according to a value of a corresponding bit of the input data during each of a plurality of data sub-frames of a frame; and applying a hysteresis reset voltage to the pixel during a hysteresis reset sub-frame of the frame.

The pixel may emit light in response to the emission data voltage and may not emit light in response to the non-emission data voltage, and a voltage-current characteristic of a driving transistor in the pixel may be initialized in response to the hysteresis reset voltage. A driving transistor in the pixel may operate in a saturation region in response to at least one of the emission data voltage or the non-emission data voltage.

The hysteresis reset voltage may have substantially a same voltage level as the emission data voltage. The hysteresis reset voltage may have substantially a same voltage level as the non-emission data voltage.

In accordance with another embodiment, a driver includes at least one signal line coupled to a pixel; and a driver circuit to drive the pixel based on a frame which includes at least one data frame and at least one hysteresis reset sub-frame. The driver circuit may apply an emission data voltage or a non-emission data voltage to the pixel during the data sub-frame, and apply a voltage to reset a driving transistor of the pixel during the hysteresis reset sub-frame.

The reset voltage may initialize a voltage-current characteristic of the driving transistor. The reset voltage may be less than the emission data voltage and non-emission data voltage. The driver circuit may apply the reset voltage along a signal path for storage in a capacitor of the pixel. The driver circuit may apply an emission control signal to the pixel during the hysteresis reset sub-frame, and the emission control signal may prevent the pixel from emitting light during the hysteresis reset sub-frame.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
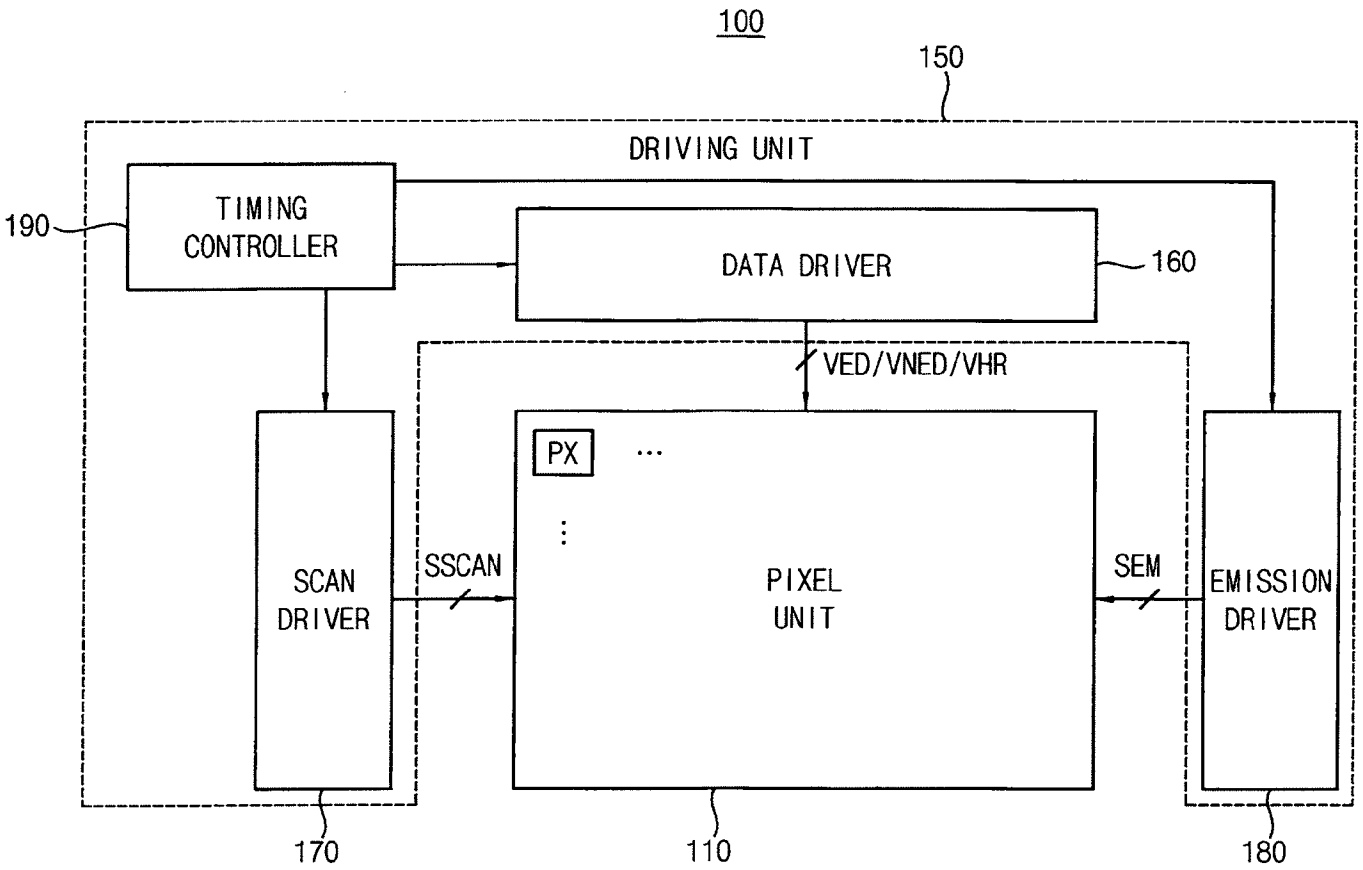
FIG. 1 illustrates an embodiment of an organic light emitting display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawing figures, the dimensions of layers and regions may be exaggerated for clarity of illustration. Like reference numerals refer to like elements throughout.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. As used herein, the term "and/or" includes any and all combinations of one or more of the associated listed items.

It will be understood that, although the terms first, second, third etc. may be used herein to describe various elements, components, regions, layers, patterns and/or sections, these elements, components, regions, layers, patterns and/or sections should not be limited by these terms. These terms are only used to distinguish one element, component, region, layer pattern, or section from another element, component, region, layer, pattern, or section. Thus, a first element, component, region, layer, or section discussed below could be termed a second element, component, region, layer, or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross sectional illustrations that are schematic illustrations of illustratively idealized example embodiments (and intermediate structures) of the inventive concept. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. The regions illustrated in the figures are schematic in nature and their shapes are not intended to illustrate the actual shape of a region of a device and are not intended to limit the scope of the inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
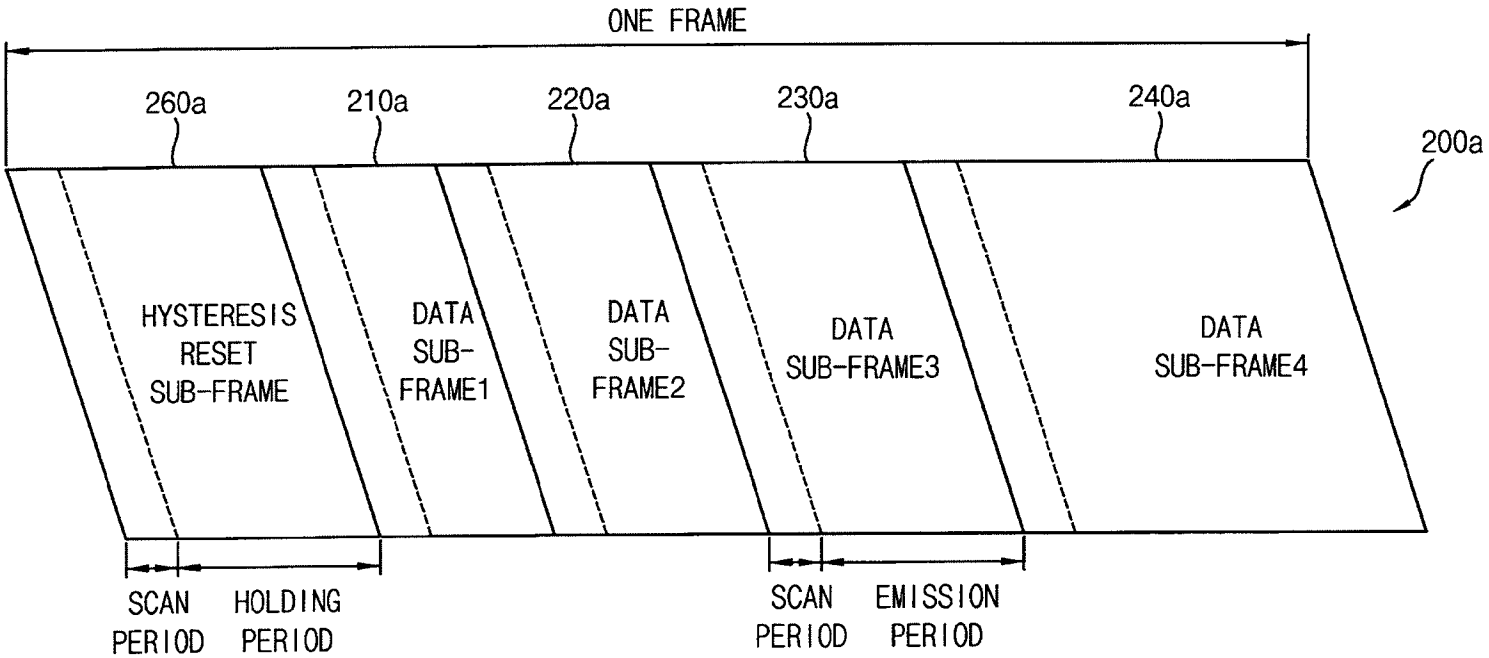
FIG. 2 illustrates an example of a frame for driving a display device.
Figure 3:
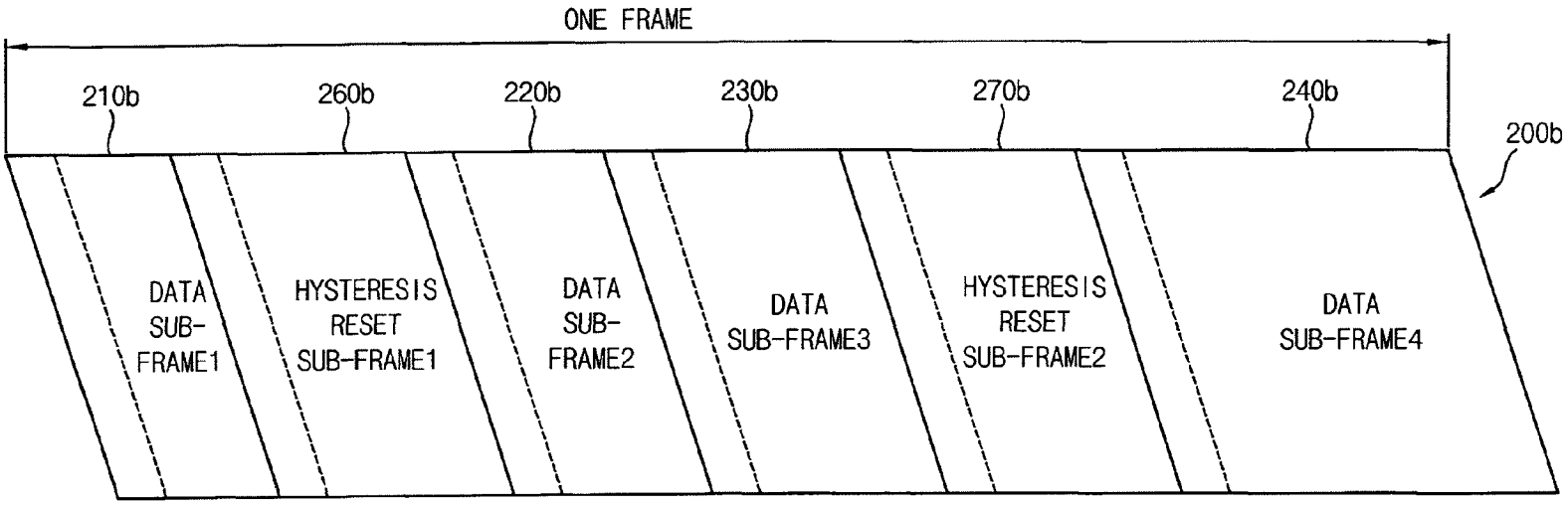
FIG. 3 illustrates another example of a frame for driving a display device.

FIG. 1 illustrates an embodiment of an organic light emitting display device, FIG. 2 illustrates an example of a frame for driving the display device, and FIG. 3 illustrates another example of a frame for driving the display device.

In the embodiment shown in FIG. 1, an organic light emitting display device 100 includes a pixel unit 110 having at least one pixel PX and a driving unit 150 that drives the pixel unit 110. The pixel unit 110 may be coupled to a data driver 160 through a plurality of data lines, may be coupled to a scan driver 170 through a plurality of scan lines, and may be coupled to an emission driver 180 through a plurality of emission control lines. The pixel unit 110 may include a plurality of pixels PX located at crossing points of the plurality of data lines and scan lines.

The driving unit 150 may drive pixel unit 110 with a predetermined driving method. In one embodiment, driving unit 150 drives pixel unit 110 with a hybrid driving method. In this method, driving unit 150 provides each pixel PX of pixel unit 110 with an emission data voltage VED or a non-emission data voltage VNED that allows a driving transistor of pixel PX to operate in a saturation region and that may produce grayscale value by adjusting a time duration for which the pixel PX emits light in each frame. By operating the driving transistor of each pixel PX in the saturation region, the lifespan of the pixels PX may be increased.

Further, in the hybrid driving method, one frame may be divided into a plurality of data sub-frames and at least one hysteresis reset sub-frame. For example, the driving unit 150 may receive input data for each pixel PX, selectively apply the emission data voltage VED or the non-emission data voltage VNED to the pixel PX according to a value of a corresponding bit of the input data at each data sub-frame, and apply a hysteresis reset voltage VHR to the pixel PX at the hysteresis reset sub-frame.

In some example embodiments, as illustrated in FIG. 2, one frame 200*a* may be divided into a plurality of data sub-frames 210*a*, 220*a*, 230*a* and 240*a* and one hysteresis reset sub-frame 260*a*. Each frame 200*a* may have a single hysteresis reset sub-frame 260*a*. Also, each data sub-frame 210*a*, 220*a*, 230*a*, and 240*a* may include a scan period and an emission period. During the scan period, the emission data voltage VED or the non-emission data voltage VNED is applied and stored in each pixel PX. During the emission period, each pixel PX emits or does not emit light according to the stored emission or non-emission data voltage VED and VNED.

Each hysteresis reset sub-frame 260*a* may include a scan period and a holding period.

During the scan period, the hysteresis reset voltage VHR is applied and stored in each pixel PX. During the holding period, the hysteresis reset voltage VHR is continuously applied to the driving transistor of each pixel PX. The number of the data sub-frames 210*a*, 220*a*, 230*a*, and 240*a* and/or the order of the sub-frames 210*a*, 220*a*, 230*a*, 240*a*, and 260*a* may be different in other embodiments.

For example, in another embodiment illustrated in FIG. 3, one frame 200*b* may be divided into a plurality of data sub-frames 210*b*, 220*b*, 230*b*, and 240*b* and a plurality of hysteresis reset sub-frames 260*b* and 270*b*. Thus, each frame 200*b* has a plurality of hysteresis reset sub-frames 260*b* and 270*b*. The number of the data sub-frames 210*b*, 220*b*, 230*b*, and 240*b* and/or the order of the sub-frames 210*b*, 220*b*, 230*b*, 240*b*, 260*b*, and 270*b* may be different in other embodiments.

The driving unit 150 may include the data driver 160, the scan driver 170, and the emission driver 180. The data driver 160 may apply the emission data voltage VED and/or the non-emission data voltage VNED to pixel unit 110 through the plurality of data lines at each data sub-frame. The data driver 160 may apply the hysteresis reset voltage VHR to the pixel unit 110 through the plurality of data lines at each hysteresis reset sub-frame. The scan driver 170 may apply a scan signal SSCAN to the pixel unit 110 through the plurality of scan lines. The emission driver 180 may apply an emission control signal SEM to the pixel unit 110 through the plurality of emission control lines.

At each data sub-frame, each pixel PX in the pixel unit 110 may store the emission data voltage VED or the non-emission data voltage VNED applied from the data driver 160 when the scan signal SSCAN is applied from the scan driver 170. Also, each pixel PX may emit or not emit light according to the stored emission or non-emission data voltage VED and VNED when the emission control signal SEM is applied from the emission driver 180.

At each hysteresis reset sub-frame, each pixel PX in the pixel unit 110 may receive and store the hysteresis reset voltage VHR applied from the data driver 160 when the scan signal SSCAN is applied from the scan driver 170. Also, each pixel PX may reset hysteresis of a driving transistor in response to the hysteresis reset voltage VHR. Thus, each pixel PX may initialize a voltage-current characteristic of the driving transistor in response to the hysteresis reset voltage VHR.

For example, a voltage-current characteristic of a driving transistor in a pixel that emits light and a voltage-current characteristic of a driving transistor in a pixel that does not emit light may be different from each other, if hysteresis is not reset. As a result, a shadow effect may occur, in which the luminance of a pixel that has continuously emitted light is different from the luminance of a pixel that did not previously emit light and then subsequently emits light.

Further, an instantaneous afterimage may appear at a boundary between the first display region and the second display region. This may happen when a first display region has emitted light and a second display region adjacent to the first display region has not emitted light, and thereafter the first and second display regions emit light.

These effects may be reduced or prevented in accordance with one or more of the organic light emitting display devices described herein. In one embodiment of the organic light emitting display device 100, the voltage-current characteristic of the driving transistor of each pixel PX may be initialized at the hysteresis reset sub-frame. Thus, all driving transistors of in the pixels PX of pixel unit 110 may have substantially the same voltage-current characteristic, which may help prevent shadow effect and the generation of instantaneous afterimages. During the hysteresis reset sub-frame, the emission driver 180 may provide each pixel PX with the emission control signal SEM having a predetermined level such that the pixel PX does not emit light.

The timing controller 190 may control an operation of the organic light emitting display device 100. For example, the timing controller 190 may provide control signals to data driver 160, scan driver 170, and emission driver 180 to control operation of the organic light emitting display device 100. In some example embodiments, data driver 160, scan driver 170, emission driver 180, and timing controller 190 may be implemented as a single integrated circuit (IC). In other example embodiments, data driver 160, scan driver 170, emission driver 180, and timing controller 190 may be implemented as two or more ICs.

As described above, in accordance with one embodiment, a frame for driving an organic light emitting display device may be divided into a plurality of data sub-frames and at least one hysteresis reset sub-frame. A hysteresis reset voltage VHR may be applied to each pixel PX during the hysteresis reset sub-frame to reset the hysteresis of the driving transistors of the pixels PX. Thus, a voltage-current characteristic of the driving transistor of the pixels PX may be initialized during the hysteresis reset sub-frame. Accordingly, a shadow effect and the generation of an instantaneous afterimage may be reduced or prevented.

Figure 4:
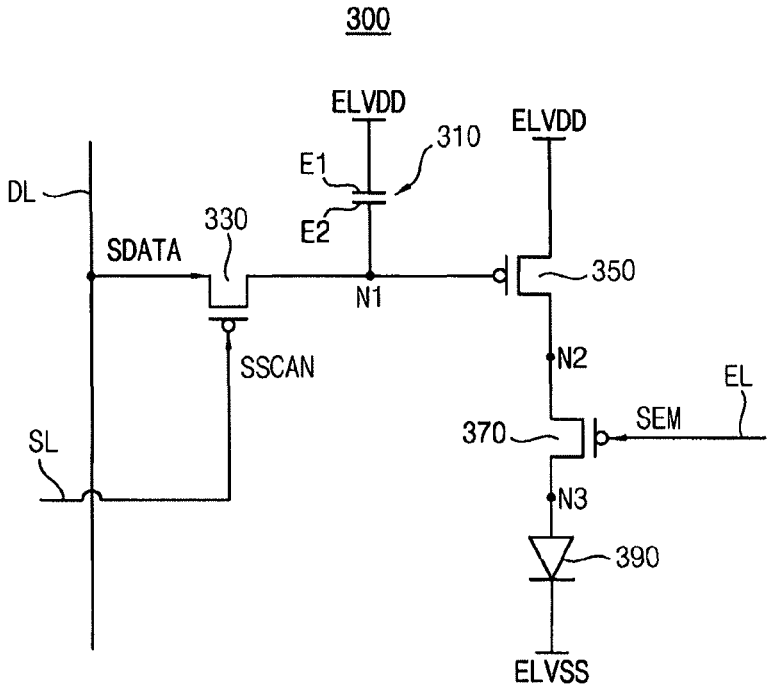
FIG. 4 illustrates an embodiment of a pixel of an organic light emitting display device.
Figure 5:
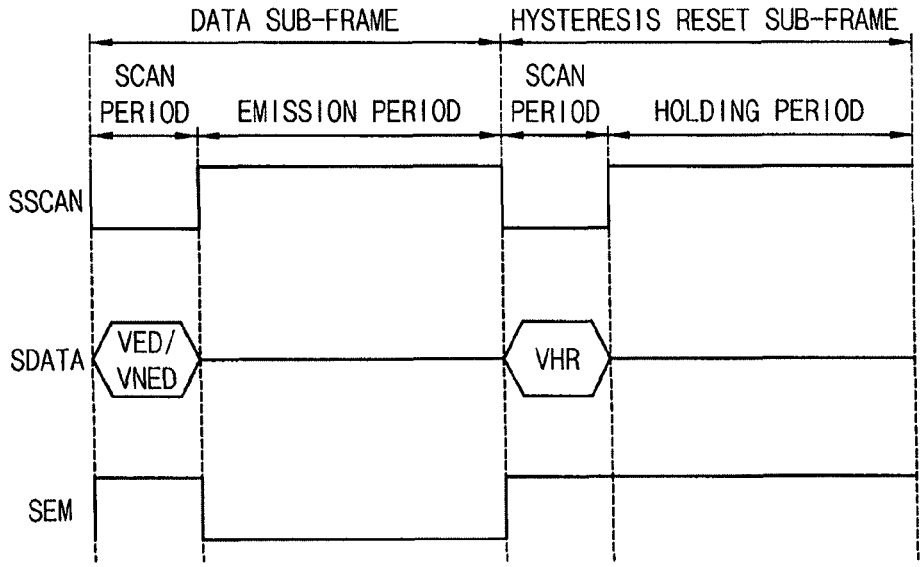
FIG. 5 is a timing diagram describing operation of the pixel of FIG. 4 in a data sub-frame and a hysteresis reset sub-frame.
Figure 6A:
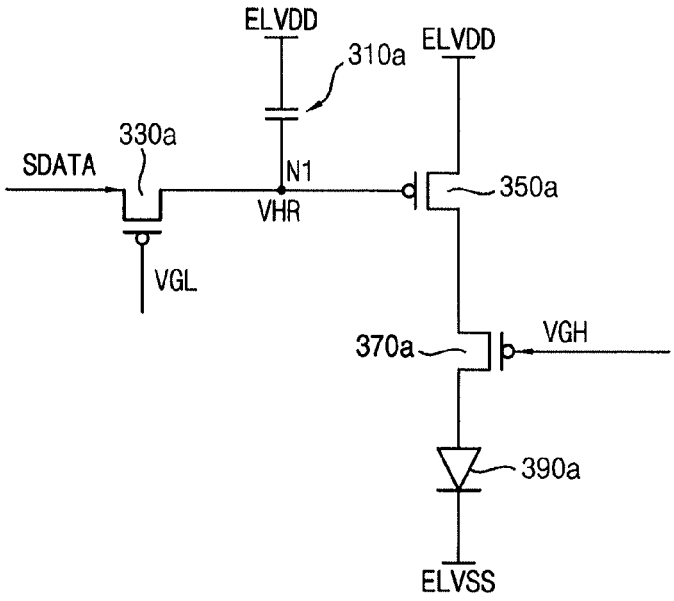
FIGS. 6A and 6B illustrate operation of the pixel of FIG. 4 in a hysteresis reset sub-frame.
Figure 6B:
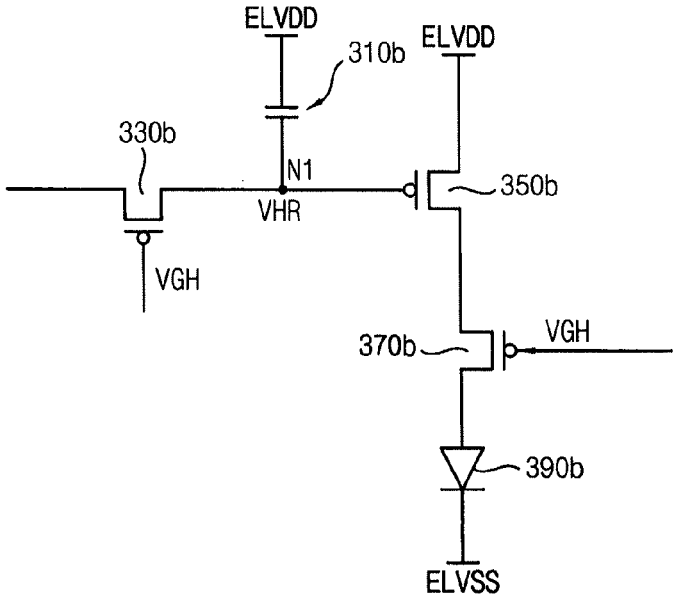
Figure 7:
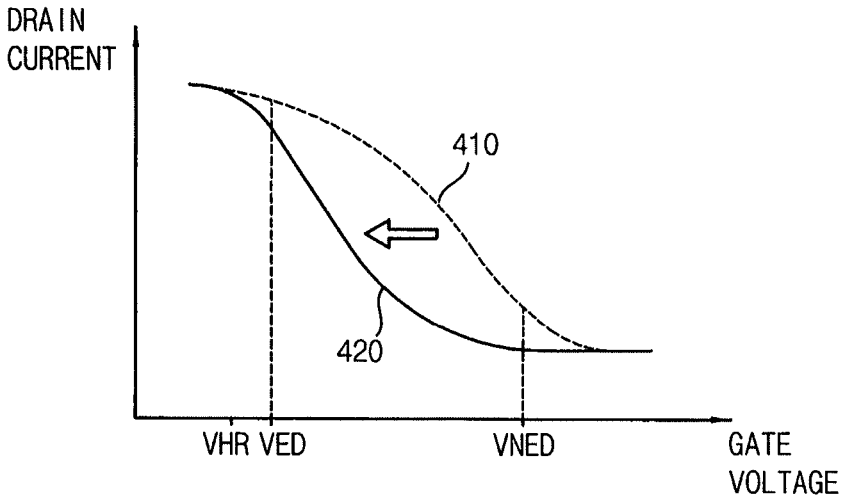
FIG. 7 illustrates a voltage-current characteristic of driving transistor of a proposed pixel.
Figure 8:
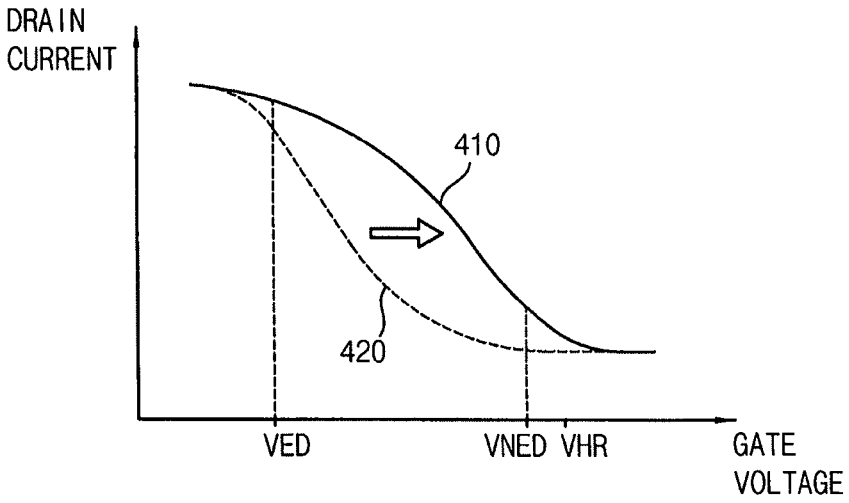
FIG. 8 illustrates a voltage-current characteristic of the driving transistor in the pixel of FIG. 4 in accordance with one embodiment.

FIG. 4 illustrates an embodiment of a pixel of an organic light emitting display device. FIG. 5 illustrates operation of the pixel of FIG. 4 at a data sub-frame and a hysteresis reset sub-frame. FIGS. 6A and 6B illustrate operation of the pixel of FIG. 4 at a hysteresis reset sub-frame. FIG. 7 illustrates a voltage-current characteristic of a driving transistor in the pixel of FIG. 4. FIG. 8 illustrates a voltage-current characteristic of a driving transistor in the pixel of FIG. 4 in accordance with example embodiments.

Referring to FIG. 4, pixel 300 may include a storage capacitor 310, a switching transistor 330, a driving transistor 350, an emission control transistor 370, and an organic light emitting diode 390. In some example embodiments, the switching transistor 330, driving transistor 350, and emission control transistor 370 may be implemented as PMOS transistors. In other embodiments, these transistors may be NMOS transistors or a combination of NMOS and CMOS transistors.

The switching transistor 330 may transfer a data signal SDATA to a first node N1 in response to a scan signal SSCAN. For example, the switching transistor 330 may have a gate terminal coupled to a scan line SL, a source terminal coupled to a data line DL, and a drain terminal coupled to the first node N1.

The storage capacitor 310 may store the data signal SDATA transferred through the switching transistor 330. For example, the storage capacitor 310 may have a first electrode E1 coupled to a first power supply voltage (e.g., a high power supply voltage) ELVDD and a second electrode E2 coupled to the first node N1.

The driving transistor 350 may generate a driving current provided to the organic light emitting diode 390 based on a voltage stored in the storage capacitor 310. For example, the driving transistor 350 may have a gate terminal coupled to the first node N1, a source terminal coupled to the first power supply voltage ELVDD, and a drain terminal coupled to a second node N2.

The emission control transistor 370 may control light emission of the organic light emitting diode 390 by selectively forming a path of the driving current to a second power supply voltage (e.g., a low power supply voltage) ELVSS in response to an emission control signal SEM. The path may pass from the first power supply voltage ELVDD through the driving transistor 350, the emission control transistor 370, and the organic light emitting diode 390. The emission control transistor 370 may have a gate terminal coupled to an emission control line EL, a source terminal coupled to the second node N2, and a drain terminal coupled to a third node N3.

The organic light emitting diode 390 may emit light based on the driving current, provided from the first power supply voltage ELVDD through the driving transistor 350, the emission control transistor 370, and the organic light emitting diode 390 to the second power supply voltage ELVSS. For example, the organic light emitting diode 390 may have an anode terminal coupled to the third node N3, and a cathode terminal coupled to the second power supply voltage ELVSS.

As previously indicated, in one embodiment, a frame for driving the organic light emitting display device may be divided into a plurality of data sub-frames and at least one hysteresis reset sub-frame. The pixel 300 may or may not emit light according to input data for the pixel 300 at the plurality of data sub-frames. Also, the voltage-current characteristic of driving transistor 350 may be initialized during the hysteresis reset sub-frame.

Referring to FIGS. 4 and 5, at a scan period of each data sub-frame, a low level voltage (e.g., a low gate voltage VGL) may be applied as the scan signal SSCAN through the scan line SL. An emission data voltage VED or a non-emission data voltage VNED may be applied as the data signal SDATA through the data line DL according to a value of a corresponding bit of the input data. For example, the emission data voltage VED may be applied when the bit of the input data has a value of 1. The non-emission data voltage VNED may be applied when the bit of the input data has a value of 0.

The switching transistor 330 may transfer the emission data voltage VED or the non-emission data voltage VNED to the second electrode E2 of the storage capacitor 310 in response to the low gate voltage VGL. The storage capacitor 310 may store charges corresponding to a voltage difference between a voltage of the first electrode E1 (i.e., the first power supply voltage ELVDD) and a voltage of the second electrode E2 (i.e., the emission data voltage VED or the non-emission data voltage VNED). Accordingly, although the switching transistor 330 is turned off, the voltage of the first node N1 may be maintained as the emission data voltage VED or the non-emission data voltage VNED.

During the emission period of each data sub-frame, a low level voltage (e.g., the low gate voltage VGL) may be applied as the emission control signal SEM through the emission control line EL. The emission control transistor 370 may be turned on in response to the low gate voltage VGL. The driving transistor 350 may be turned on when the voltage of the first node N1 (i.e., the voltage of the second electrode E2 of the storage capacitor 310) is the emission data voltage VED. The driving transistor 350 may be turned off when the voltage of the first node N1 is the non-emission data voltage VNED. In a case where both of the driving transistor 350 and the emission control transistor 370 are turned on, a path of the driving current may be formed to the second power supply voltage ELVSS, and the organic light emitting diode 390 may emit light based on the driving current. The path may pass from the first power supply voltage ELVDD through the driving transistor 350, the emission control transistor 370, and the organic light emitting diode 390.

At the data sub-frame, the driving transistor 350 may be provided with the emission data voltage VED and the non-emission data voltage VNED having predetermined voltage levels. Thus, the driving transistor 350 may operate in a saturation region. Accordingly, the lifespan of the pixel 300 may be increased.

Referring to FIGS. 4, 5, and 6A, during a scan period of each hysteresis reset sub-frame, a low level voltage (e.g., the low gate voltage VGL) may be applied as the scan signal SSCAN through the scan line SL. A hysteresis reset voltage VHR may be applied as the data signal SDATA through the data line DL. As illustrated in FIG. 6A, the switching transistor 330*a* may transfer the hysteresis reset voltage VHR to the first node N1 in response to the low gate voltage VGL. The storage capacitor 310*a* may store charges corresponding to a voltage difference between the first power supply voltage ELVDD and the voltage of the first node N1, or the hysteresis reset voltage VHR.

During a holding period of each hysteresis reset sub-frame, a high level voltage (e.g., a high gate voltage VGH) may be applied as the scan signal SSCAN through the scan line SL. Although the switching transistor 330*b* may be turned off in response to the high gate voltage VGH, the voltage of the first node N1 may be maintained as the hysteresis reset voltage VHR by the storage capacitor 310*b*. The hysteresis reset voltage VHR may be applied to the gate terminal of the driving transistor 350*b*, and the first power supply voltage ELVDD may be applied to the source terminal of the driving transistor 350*b*. This may result in the initialization of the voltage-current characteristic of the driving transistor 350*b*.

In some example embodiments, the hysteresis reset voltage VHR may have a voltage level equal to or lower than that of the emission data voltage VED. Thus, the hysteresis reset voltage VHR may have a voltage level lower than that of the emission data voltage VED and lower than that of the non-emission data voltage VNED.

FIG. 7 illustrates one type of organic light emitting display device which has been proposed.

In this device, a driving transistor of a pixel has a first voltage-current characteristic 420 (e.g., a voltage-current characteristic of an on-state) if the pixel continuously emits light. The driving transistor has a second voltage-current characteristic 410 (e.g., a voltage-current characteristic of an off-state) if the pixel continuously does not emit light. In this case, the luminance of a pixel including a driving transistor having the first voltage-current characteristic 420 may be different from luminance of a pixel including a driving transistor having the second voltage-current characteristic 410. Thus, a shadow effect and an instantaneous afterimage may occur, and image quality may be deteriorated.

However, in accordance with one embodiment of an organic light emitting display device, the hysteresis reset voltage VHR equal to or lower than the emission data voltage VED is applied to the gate terminal of the driving transistor 350, 350*a*, and 350*b* in the pixel 300 during the hysteresis reset sub-frame. Thus, the voltage-current characteristic of the driving transistor 350, 350*a*, and 350*b* in the pixel 300 may be initialized to the first voltage-current characteristic 420 (e.g., the voltage-current characteristic of the on-state). Accordingly, all pixels 300 in the organic light emitting display device according to an example embodiment may have substantially the same voltage-current characteristic 420, which may help prevent the shadow effect and the instantaneous afterimage.

In other example embodiments, the hysteresis reset voltage VHR may have a voltage level equal to or higher than that of the non-emission data voltage VNED. As illustrated in FIG. 8, the hysteresis reset voltage VHR equal to or higher than the non-emission data voltage VNED is applied to the gate terminal of the driving transistor 350, 350*a*, and 350*b* in pixel 300 during the hysteresis reset sub-frame. Thus, the voltage-current characteristic of the driving transistor 350, 350*a*, and 350*b* in pixel 300 may be initialized to the second voltage-current characteristic 410 (e.g., the voltage-current characteristic of the off-state). Accordingly, all pixels 300 in the organic light emitting display device according to an example embodiment may have substantially the same voltage-current characteristic 410, which may help prevent the shadow effect and the instantaneous afterimage.

During the scan period of the hysteresis reset sub-frame, a high level voltage (e.g., the high gate voltage VGH) may be applied as the emission control signal SEM through the emission control line EL. Accordingly, the emission control transistor 370*a* may be turned off. Thus, the organic light emitting diode 390*a* may not emit light. Also during the holding period of the hysteresis reset sub-frame, the high level voltage (e.g., the high gate voltage VGH) may be applied as the emission control signal SEM through the emission control line EL, to turn off the emission control transistor 370*b*. Thus, the organic light emitting diode 390*b* may not emit light. Thus, during the hysteresis reset sub-frame, the emission control transistor 370, 370*a*, and 370*b* may be turned off to prevent the organic light emitting diode 390*b* from emitting light. Thus, the hysteresis reset sub-frame may not affect an image displayed by the organic light emitting display device.

As described above, according to example embodiments, during at least one hysteresis reset sub-frame in each frame, the voltage-current characteristic of the driving transistor 350 may be initialized by applying the hysteresis reset voltage VHR to the driving transistor 350. Accordingly, shadow effect and the generation of an instantaneous afterimage may be reduced or prevented.

Figure 9:
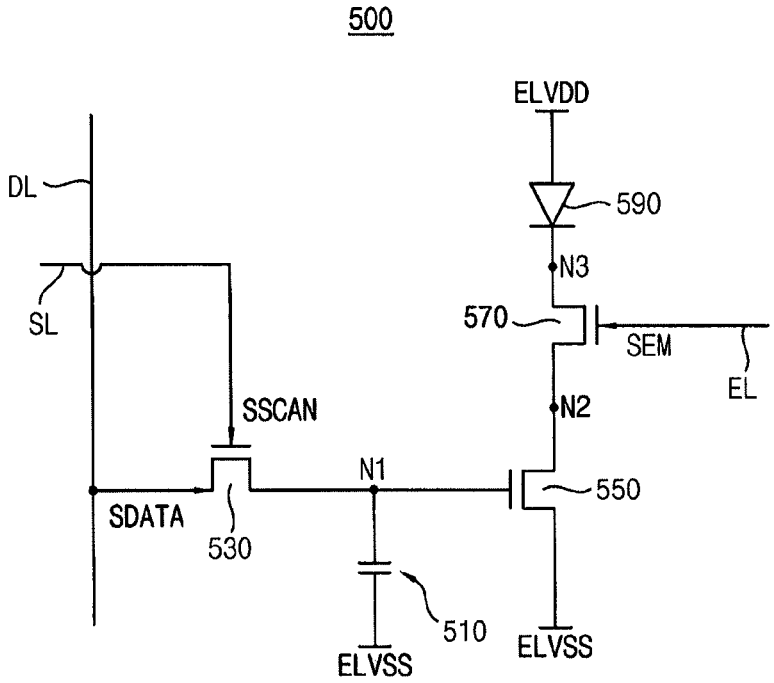
FIG. 9 illustrates another embodiment of a pixel of an organic light emitting display device.

FIG. 9 illustrates another embodiment of a pixel of an organic light emitting display device.

Referring to FIG. 9, a pixel 500 of an organic light emitting display device may include a storage capacitor 510, a switching transistor 530, a driving transistor 550, an emission control transistor 570, and an organic light emitting diode 590. The pixel 500 of FIG. 9 may have a similar configuration and operation to a pixel 300 of FIG. 4, except that the switching transistor 530, the driving transistor 550, and the emission control transistor 570 are implemented as NMOS transistors.

In some example embodiments, in the pixel 500 of FIG. 9 where the transistors 530, 550 and 570 are implemented as NMOS transistors, a hysteresis reset voltage VHR equal to or higher than that of an emission data voltage VED may be used. In other example embodiments, the hysteresis reset voltage VHR equal to or lower than that of a non-emission data voltage VNED may be used.

During at least one hysteresis reset sub-frame included in each frame, the voltage-current characteristic of driving transistor 550 of pixel 500 may be initialized by applying the hysteresis reset voltage VHR to the driving transistor 550. Accordingly, in the organic light emitting display device including the pixel 500, the shadow effect and the instantaneous afterimage may be reduced or prevented.

Figure 10:
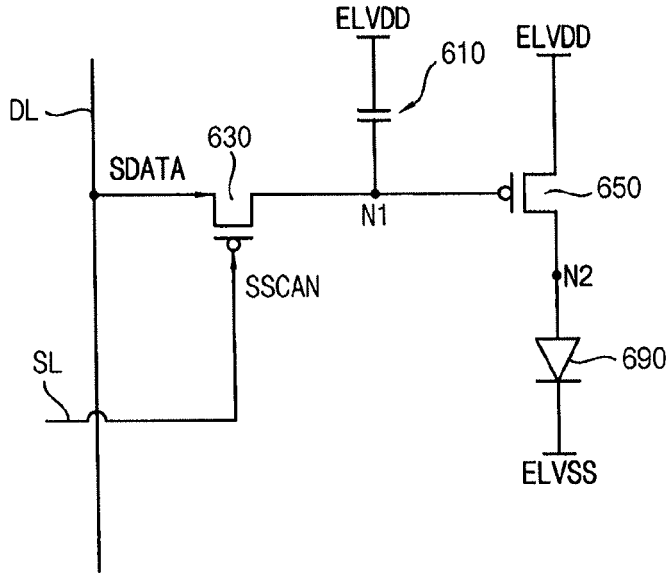
FIG. 10 illustrates another embodiment of a pixel of an organic light emitting display device.

FIG. 10 illustrates another embodiment of a pixel 600 of an organic light emitting display device.

Referring to FIG. 10, pixel 600 may include a storage capacitor 610, a switching transistor 630, a driving transistor 650, and an organic light emitting diode 690. The pixel 600 of FIG. 10 may have similar configuration and operation to pixel 300 in FIG. 4, except that pixel 600 does not include an emission control transistor.

The storage capacitor 610 may have a first electrode coupled to a first power supply voltage ELVDD, and a second electrode coupled to a first node N1. The switching transistor may couple a data line DL to the first node N1 in response to a scan signal SSCAN. The driving transistor 650 may have a gate terminal coupled to the first node N1, a source terminal coupled to the first power supply voltage ELVDD, and a drain terminal coupled to a second node N2. The organic light emitting diode 690 may have an anode terminal coupled to the second node N2, and a cathode terminal coupled to a second power supply voltage ELVSS. In some example embodiments, the switching transistor 630 and driving transistor 650 may be PMOS transistors. In other example embodiments, the switching transistor 630 and the driving transistor 650 may be NMOS transistors.

During a hysteresis reset sub-frame, the second power supply voltage ELVSS may increase to have a voltage level equal to or higher than that of the first power supply voltage ELVDD. Thus, current may not flow from the first power supply voltage ELVDD to the second power supply voltage ELVSS. Accordingly, the organic light emitting diode 690 may not emit light during the hysteresis reset sub-frame.

Figure 11:
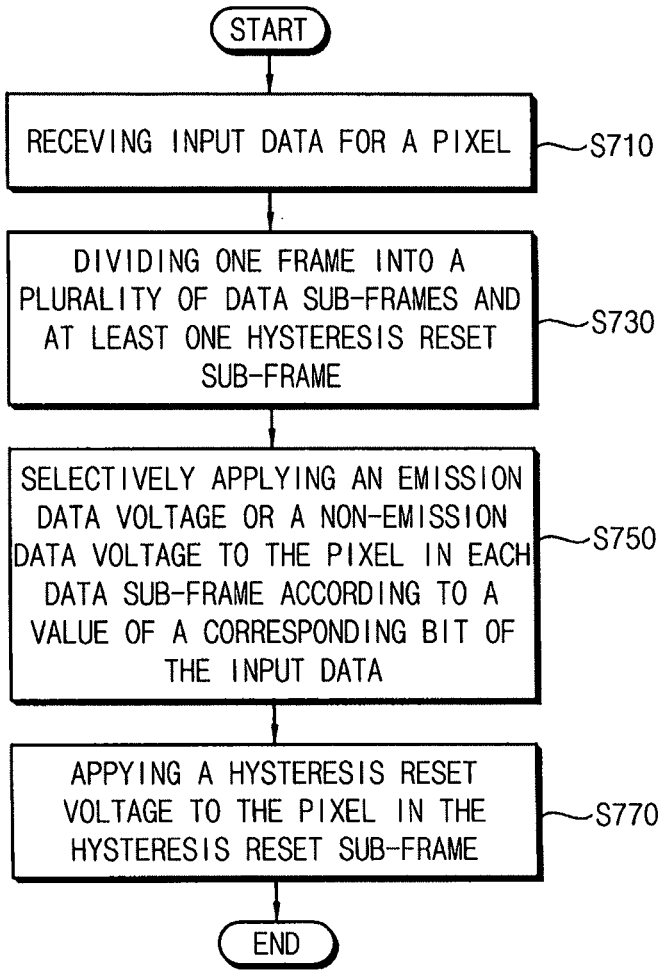
FIG. 11 illustrates an embodiment of a method for driving an organic light emitting display device.

FIG. 11 illustrates an embodiment of a method of driving an organic light emitting display device.

Referring to FIG. 11, in this method, a driving unit may receive input data for the pixel (S710). The driving unit may drive the pixel using a hybrid driving method. Thus, the driving unit may divide one frame into a plurality of data sub-frames and at least one hysteresis reset sub-frame (S730). The driving unit may selectively apply an emission data voltage or a non-emission data voltage to the pixel according to a value of a corresponding bit of the input data at each data sub-frame (S750). The pixel may emit light in response to the emission data voltage, and may not emit light in response to the non-emission data voltage. In some example embodiments, a driving transistor in the pixel may operate in a saturation region in response to the emission data voltage and the non-emission data voltage, thereby improving the lifespan of the pixel.

The driving unit may apply a hysteresis reset voltage to the pixel at the hysteresis reset sub-frame (S770). The pixel may initialize a voltage-current characteristic of the driving transistor in response to the hysteresis reset voltage. In some example embodiments, the hysteresis reset voltage may have the same voltage level as the emission data voltage, and the voltage-current characteristic of the driving transistor may be initialized to a voltage-current characteristic of an on-state. In other example embodiments, the hysteresis reset voltage may have the same voltage level as the non-emission data voltage, and the voltage-current characteristic of the driving transistor may be initialized to a voltage-current characteristic of an off-state.

As described above, in this method embodiment, one frame may be divided into a plurality of data sub-frames and at least one hysteresis reset sub-frame. A hysteresis reset voltage may be applied to each pixel at the hysteresis reset sub-frame. This may result in reset of hysteresis of a driving transistor of each pixel. Thus, the voltage-current characteristic of the driving transistor may be initialized during the hysteresis reset sub-frame, which may help prevent the shadow effect and the instantaneous afterimage.

Figure 12:
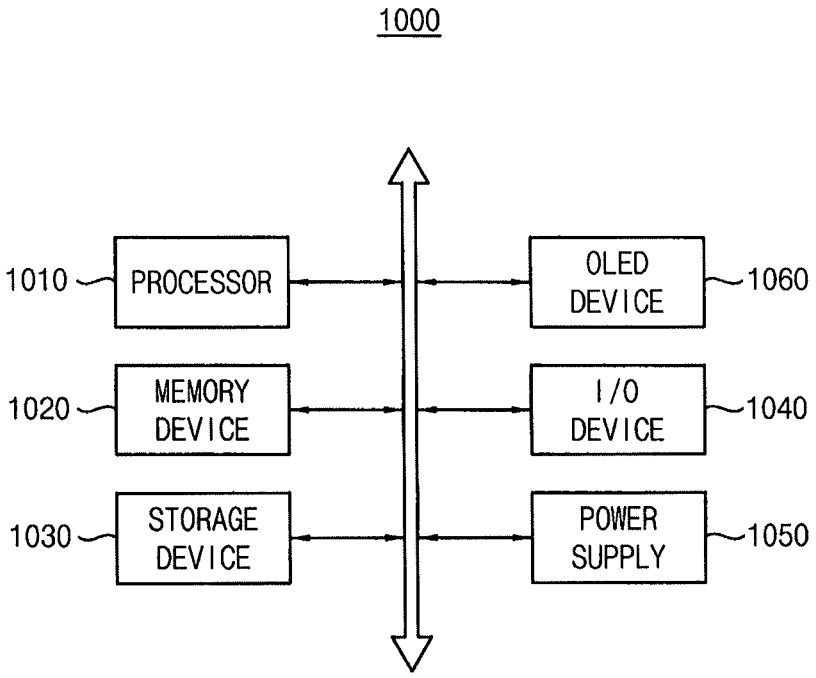
FIG. 12 illustrates an embodiment of an electronic system including an organic light emitting display device.

FIG. 12 illustrates an embodiment of an electronic system 1000 including an organic light emitting display device.

Referring to FIG. 12, electronic system 1000 includes a processor 1010, a memory device 1020, a storage device 1030, an input/output (I/O) device 1040, a power supply 1050, and an organic light emitting display device 1060. The electronic system 1000 may include a plurality of ports for communicating a video card, a sound card, a memory card, a universal serial bus (USB) device, other electronic systems, etc.

The processor 1010 may perform various computing functions or tasks. The processor 1010 may be, for example, a microprocessor, a central processing unit (CPU), etc. The processor 1010 may be connected to other components via an address bus, a control bus, a data bus, etc. Further, the processor 1010 may be coupled to an extended bus such as a peripheral component interconnection (PCI) bus.

The memory device 1020 may store data for operations of the electronic system 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1030 may be, for example, a solid state drive (SSD) device, a hard disk drive (HDD) device, a CD-ROM device, etc. The I/O device 1040 may be, for example, an input device such as a keyboard, a keypad, a mouse, a touch screen, etc, and/or an output device such as a printer, a speaker, etc. The power supply 1050 may supply power for operations of electronic system 1000. The organic light emitting display device 1060 may communicate with other components via the buses or other communication links.

A frame for driving organic light emitting display device 1060 may be divided into a plurality of data sub-frames and at least one hysteresis reset sub-frame. A hysteresis reset voltage may be applied to each pixel at the hysteresis reset sub-frame, which results in the reset of hysteresis of the driving transistor of each pixel. Thus, the voltage-current characteristic of the driving transistor may be initialized during the hysteresis reset sub-frame, which may help prevent the shadow effect and the instantaneous afterimage.

Example embodiments may be applied to any electronic system 1000 having the organic light emitting display device 1060. For example, example embodiments may be applied to the electronic system 1000 such as a television, a computer monitor, a laptop, a digital camera, a cellular phone, a smart phone, a personal digital assistant (PDA), a portable multimedia player (PMP), an MP3 player, a navigation system, a video phone, etc.

By way of summation and review, in digital driving methods, the luminance of a pixel that continuously emits light may be different from the luminance of a pixel that does not continuously emit light, e.g., one that did not emit light at a previous time and then emits light at another time. This condition may be referred to as a shadow effect Also, in digital driving methods, an instantaneous afterimage may appear at a boundary between adjacent display regions. Such an afterimage may occur, for example, where, after a first display region has emitted light and an adjacent second display region has not emitted light, the first and second display regions emit light.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting display device, comprising:

a pixel unit including at least one pixel; and a driving unit to drive the pixel unit, wherein each frame for driving the pixel in the pixel unit is divided into a plurality of data sub-frames and at least one hysteresis reset sub-frame between the data sub-frames within the frame, and wherein the driving unit is to:

receive input data for the pixel, selectively apply an emission data voltage or a non-emission data voltage to the pixel according to a value of a corresponding bit of the input data during each data sub-frame, and apply a hysteresis reset voltage having substantially a same voltage level as the emission data voltage to the pixel during the hysteresis reset sub-frame such that a voltage-current characteristic of a driving transistor of the pixel is initialized to an on-state during the hysteresis reset sub-frame, and wherein the pixel comprises:

a storage capacitor having a first electrode coupled to a first power supply voltage and a second electrode coupled to a first node;

a switching transistor to couple a data line to the first node in response to a scan signal;

the driving transistor includes a gate terminal coupled to the first node, a source terminal coupled to the first power supply voltage, and a drain terminal coupled to a second node;

an emission control transistor having a gate terminal coupled to an emission control line, a source terminal coupled to the second node, and a drain terminal coupled to a third node, the emission control transistor being turned off during the hysteresis reset sub-frame; and an organic light emitting diode having an anode terminal coupled to the third node, and a cathode terminal coupled to a second power supply voltage.

2. The display device as claimed in claim 1, wherein:

the pixel emits light in response to the emission data voltage and does not emit light in response to the non-emission data voltage.

3. The display device as claimed in claim 1, wherein the driving transistor in the pixel operates in a saturation region in response to at least one of the emission data voltage or the non-emission data voltage.

4. The display device as claimed in claim 1, wherein the hysteresis reset sub-frame is the only hysteresis reset sub-frame included in the frame.

5. The display device as claimed in claim 1, wherein the frame includes two or more hysteresis reset sub-frames.

6. The display device as claimed in claim 1, wherein, during the hysteresis reset sub-frame, the emission control transistor is turned off and the organic light emitting diode does not emit light.

7. The display device as claimed in claim 1, wherein the switching transistor, the driving transistor, and the emission control transistor are implemented as PMOS transistors.

8. The display device as claimed in claim 1, wherein the switching transistor, driving transistor, and emission control transistor are implemented as NMOS transistors.

9. The display device as claimed in claim 1, wherein, during the hysteresis reset sub-frame, the second power supply voltage has a voltage level equal to or higher than a voltage level of the first power supply voltage and the organic light emitting diode does not emit light.

10. A driver, comprising:

at least one signal line coupled to a pixel; and a driver circuit to drive the pixel based on each frame which includes a plurality of data sub-frames and at least one hysteresis reset sub-frame between the data sub-frames within the frame, wherein the driver circuit is to apply an emission data voltage or a non-emission data voltage to the pixel during each data sub-frame, and to apply a reset voltage to reset a driving transistor of the pixel during the hysteresis reset sub-frame, wherein the reset voltage has substantially a same voltage level as the emission data voltage such that a voltage-current characteristic of the driving transistor is initialized to an on-state during the hysteresis reset sub-frame, and wherein the pixel comprises:

a storage capacitor having a first electrode coupled to a first power supply voltage and a second electrode coupled to a first node;

a switching transistor to couple a data line to the first node in response to a scan signal;

the driving transistor includes a gate terminal coupled to the first node, a source terminal coupled to the first power supply voltage, and a drain terminal coupled to a second node;

an emission control transistor having a gate terminal coupled to an emission control line, a source terminal coupled to the second node, and a drain terminal coupled to a third node, the emission control transistor being turned off during the hysteresis reset sub-frame; and an organic light emitting diode having an anode terminal coupled to the third node, and a cathode terminal coupled to a second power supply voltage.

11. The driver as claimed in claim 10, wherein the driver circuit applies the reset voltage along a signal path for storage in the capacitor of the pixel.

12. The driver as claimed in claim 10, wherein:

the driver circuit applies an emission control signal to the pixel during the hysteresis reset sub-frame, the emission control signal preventing the pixel from emitting light during the hysteresis reset sub-frame.

* * * * *